US006986569B2

(12) United States Patent
Toba et al.

(10) Patent No.: US 6,986,569 B2
(45) **Date of Patent: *Jan. 17, 2006**

(54) INK CARTRIDGE AND ITS MANUFACTURING METHOD

(75) Inventors: Koichi Toba, Nagano (JP); Satoshi Shinada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/929,581

(22) Filed: Aug. 31, 2004

(65) Prior Publication Data

US 2005/0030356 A1 Feb. 10, 2005

Related U.S. Application Data

(63) Continuation of application No. 10/246,757, filed on Sep. 19, 2002, now Pat. No. 6,796,642.

(30) Foreign Application Priority Data

Sep. 19, 2001 (JP) ..... P2001-285082
Sep. 19, 2001 (JP) ..... P2001-285083

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS 5,182,581 A 1/1993 Kashimura et al.
5,488,401 A 1/1996 Mochizuki et al.
5,754,207 A 5/1998 Gragg et al.
5,949,461 A * 9/1999 Jones et al. ..... 347/87
6,074,049 A * 6/2000 Machler ..... 347/86
6,168,266 B1 1/2001 Ishinaga et al.
6,422,691 B2 7/2002 Kobayashi et al.
6,490,792 B1 12/2002 Ishinaga et al.
6,796,642 B2 * 9/2004 Toba et al. ..... 347/85

FOREIGN PATENT DOCUMENTS

EP 0 602 969 A1 6/1994
EP 0 709 210 A1 5/1996
EP 0 710 561 A2 5/1996
EP 0 765 756 A2 4/1997
JP 03-136861 6/1991
JP 03-136862 6/1991
JP 05-162324 6/1993
JP 06-040043 2/1994

(Continued)

*Primary Examiner*—Anh T. N. Vo
(74) *Attorney, Agent, or Firm*—Sughrue Mion, PLLC

(57) ABSTRACT

An ink cartridge which supplies ink to an ink jet recording apparatus through an ink supply needle of the ink jet recording apparatus, has a container body having a shape of an approximately rectangular parallelepiped including an ink supply surface on which an ink supply passage into which the ink supply needle is inserted is provided, in which the height of a side surface approximately orthogonal to the ink supply surface is larger than at least one width of the ink supply surface, and one of the side surfaces is an opening surface opened in the direction of the width; a lid member, which has the approximately same shape as the opening surface and seals the opening surface of the container body; and a porous member, which has the approximately same shape as the container body and is housed in a space formed by the container body and lid member.

11 Claims, 20 Drawing Sheets

FOREIGN PATENT DOCUMENTS

| | | |
|---|---|---|
| JP | 07-025024 | 1/1995 |
| JP | 07-060978 | 3/1995 |
| JP | 08-039819 | 2/1996 |
| JP | 08-132638 | 5/1996 |
| JP | 08-207298 | 8/1996 |
| JP | 08-207302 | 8/1996 |
| JP | 08-290582 | 11/1996 |
| JP | 09-094973 | 4/1997 |
| JP | 10-095130 | 4/1998 |
| JP | 10-250104 | 9/1998 |
| JP | 10-278288 | 10/1998 |
| JP | 2000-351218 | 12/2000 |
| JP | 2001-113717 | 4/2001 |

* cited by examiner

INK CARTRIDGE AND ITS MANUFACTURING METHOD

This is a continuation of U.S. patent application Ser. No. 10/246,757 filed Sep. 19, 2002, U.S. Pat. No. 6,796,642, the disclosure of which is incorporated by reference.

BACKGROUND OF THE INVENTION

The present invention relates to an ink cartridge and its manufacturing method. Particularly, the invention relates to an ink cartridge which supplies ink to an ink jet recording apparatus through an ink supply needle of the ink jet recording apparatus.

There is an ink jet recording apparatus in which an ink cartridge is detachably mounted onto a carriage having an ink jet recording head thereby to supply ink. As an example of this ink cartridge, there is an ink cartridge having an outline of an approximately rectangular parallelepiped, in which a porous member including ink therein is housed. In this ink cartridge, since the ink is held into the ink cartridge, negative pressure is generated inside the ink cartridge.

This type of ink cartridge is made up of a container body having a shape of an approximately rectangular parallelepiped and the opened upper surface. The container body is provided, at its bottom surface, with an ink supply passage into which an ink supply needle of the ink jet recording apparatus is inserted. The porous member is inserted into the container body from the upper surface, and the upper surface is sealed by a lid member, whereby the ink cartridge is manufactured.

The porous member is inserted into the container body from the upper surface in order to press a portion of the porous member near the ink supply passage against the ink supply passage and the ink supply surface thereby to compress this portion of the porous member. The higher the density of the porous member becomes due to compression, the stronger its capillary power becomes, so that the compressed porous member can collect ink. Therefore, in order to decrease a shortage of ink supply, the above manufacturing method is used so that ink can be collected to the portion of the porous member near the ink supply surface.

However, in an On-carriage type of ink jet recording apparatus in which an ink cartridge is mounted onto a movable carriage having an ink recording head, in order to mount as many ink cartridges as possible on the carriage, there is a tendency to reduce the width of the ink cartridge in the scanning direction of the carriage. Particularly, a color ink jet recording apparatus can mount ink cartridges holding ink of four or more colors in order to improve color reproduction. In this case, it is desirable that the width of the ink cartridge in the carriage moving direction is made as small as possible in order to make the width of the recording apparatus small and further the height of each ink cartridge is several times as large as the width thereof in order to secure the enough ink capacity.

For the ink cartridge that is thus high and narrow, it is difficult to insert the porous member into the container from the upper surface of the container. Namely, the porous member has compressibility, and it is not easy to insert such the porous member into the narrow and long space where friction is large.

Therefore, an object of the invention is to provide an ink cartridge which can solve the above problem and its manufacturing method.

Further, the above ink cartridge of which the height is larger than the width thereof is weak in mechanical strength in the width direction. Namely, in the side surface of the ink cartridge, its surrounding portion is only connected to other surfaces. Therefore, regarding the side surface having the large height and large area, its central portion is not supported by any members. Consequently, in case that pressure reduction is performed by letting air out of the inside of the ink cartridge in order to make the inside of the ink cartridge in a negative pressure state, the side surface having this large area is easy to deform. In case that this deformation exceeds an allowable size of the cartridge, there is fear that the ink cartridge is broken. Further, in case that the user or the like holds the central portions of the side surfaces of the ink cartridge opposed to each other so as to pinch them, that is, in case that the strong power is applied to these portions, there is fear that the ink cartridge is broken.

Therefore, it is another object of the invention to provide an ink cartridge which can solve the above problem.

SUMMARY OF THE INVENTION

According to the invention, in manufacture of an ink cartridge, a porous member is inserted into a container body from an opening surface side. Accordingly, insertion of the porous member is easy. Further, after a portion of the porous member near an ink supply passage is pressed against a pressure-contacting portion and compressed, the porous member is inserted into the container body. Therefore, ink collects around the ink supply passage, so that it is possible to provide an ink cartridge that supplies ink stably.

According to the invention, a reinforcing structure is provided for the inside of ink cartridge. Therefore, the mechanical strength of the ink cartridge in the width direction can be reinforced. Further, the porous member has a shape avoiding the reinforcing structure and surrounding it. Therefore, it is possible to prevent ink from collecting unnecessarily around the reinforcing structure. As the reinforcing structure, rib is preferable.

The present disclosure relates to the subject matter, contained in Japanese patent application Nos. 2001-285082 and 2001-285083 (both filed on Sep. 19, 2001), which are expressly incorporated herein by reference in their entireties.

DESCRIPTION OF THE PREFERRED EMBODIMENT

Though the invention according to claims will be described below with reference to embodiments, it is not limited to the following embodiments, and all the combinations of features described in the embodiments are not essential to means for solving the invention.

Figure 1:
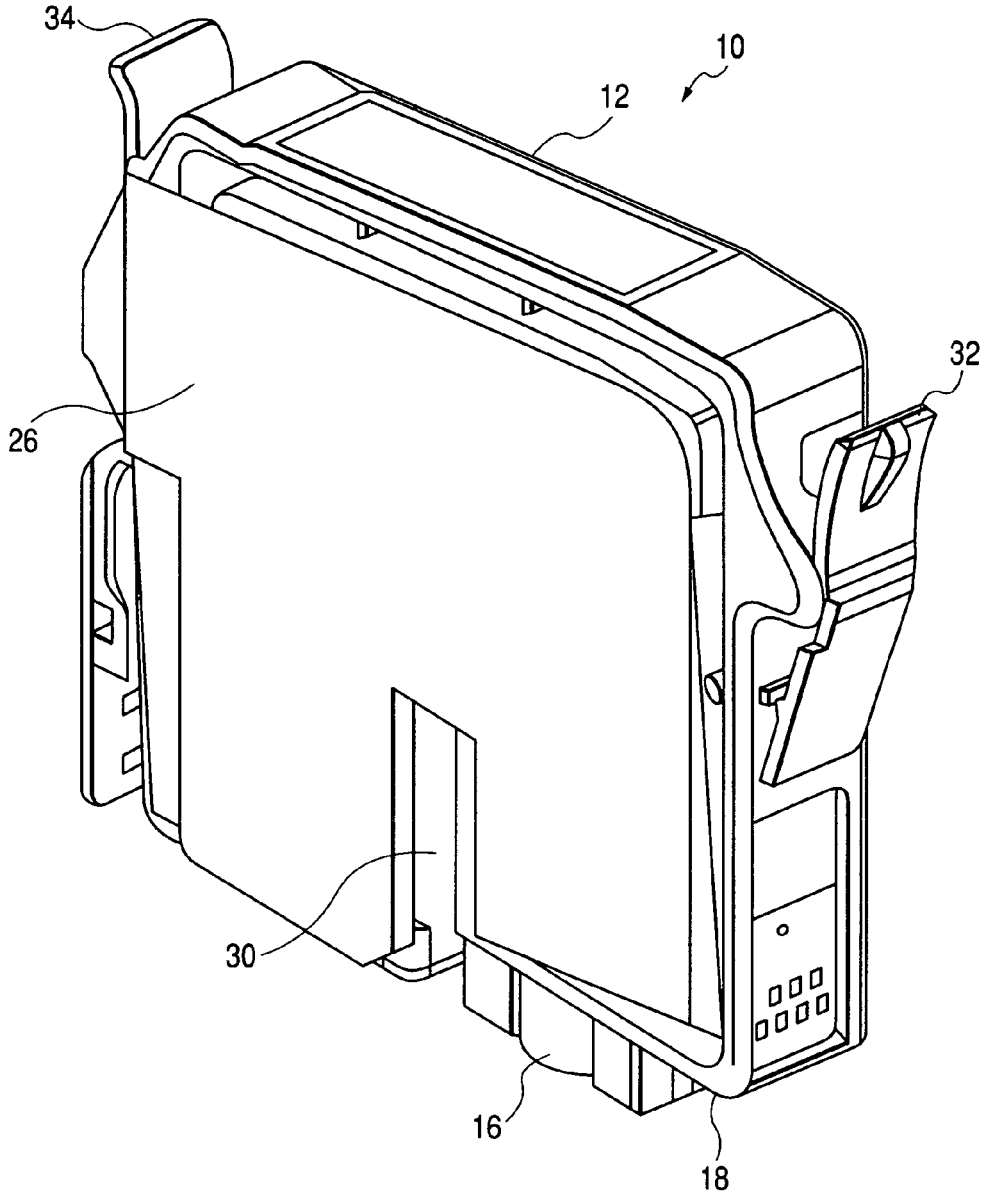
FIG. 1 is a front perspective view of an ink cartridge according to a first embodiment of the invention.
Figure 2:
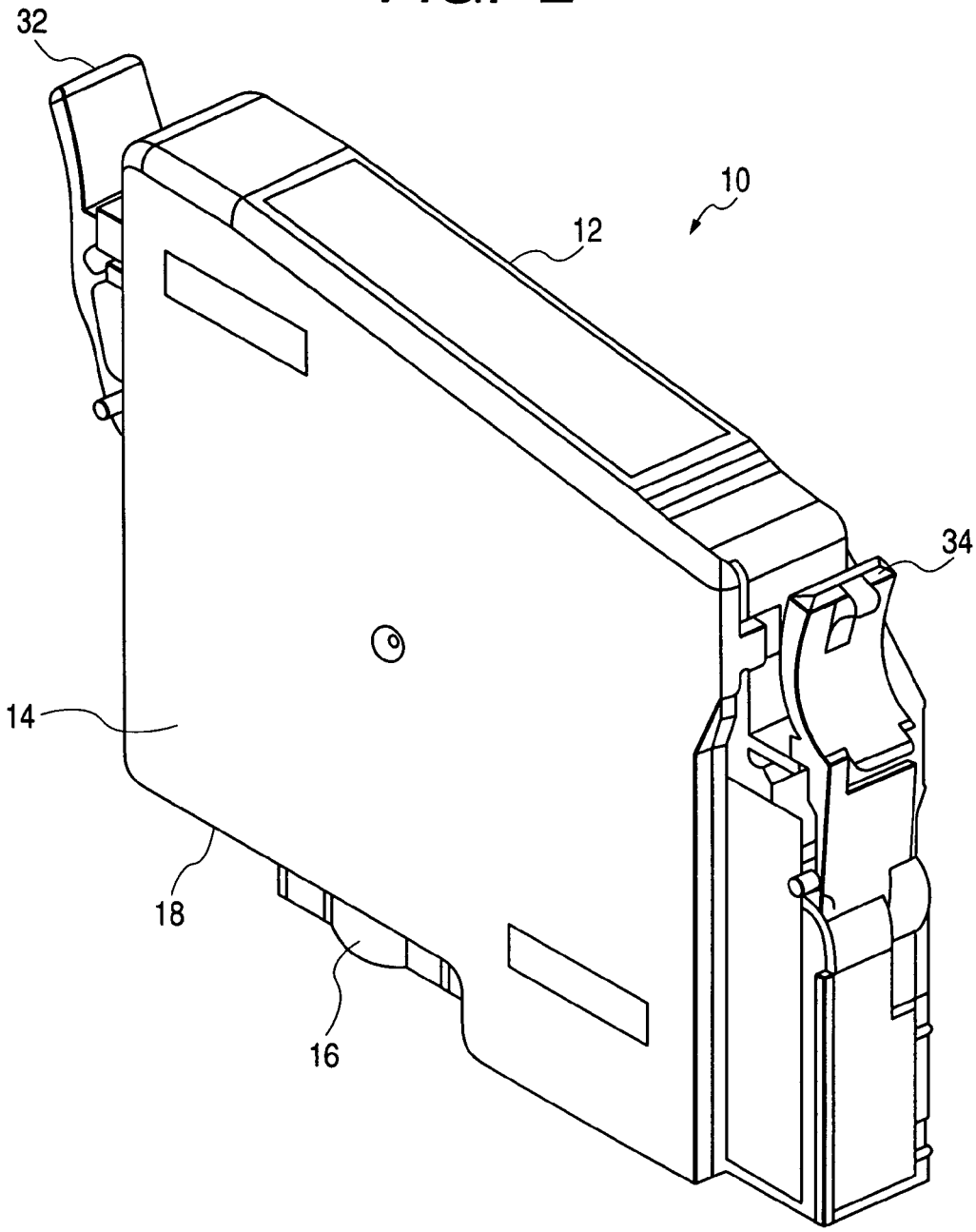
FIG. 2 is a rear perspective view of the ink cartridge in FIG. 1.

FIG. 1 is a front perspective view of an ink cartridge according to a first embodiment of the invention. FIG. 2. is a rear perspective view of the ink cartridge in FIG. 1. An ink cartridge 10 includes a container body 12 and a lid member 14, and has an outline of an approximately rectangular parallelepiped as a whole. The container body 12 has an ink supply surface 18 including an ink supply passage 16 into which an ink supply needle of an ink jet recording apparatus is inserted.

In the vicinity of the ink supply passage 16 and on a center side of the container body, there is provided a slit portion 30 extending from the ink supply surface 18 of the container body 12 in the inserting direction of the ink supply needle. By this slit portion 30, the insertion of the ink supply needle into the ink cartridge 10 is regulated so that an opening surface of the ink supply passage 16 is orthogonal to the ink supply needle before the leading end of the ink supply passage 16 reaches the ink supply needle, so that the ink supply needle can be surely inserted into the ink supply passage 16.

Further, at the upper portions of side surfaces of the container body 12, fitting members 32 and 34 respectively fitting to a carriage of the ink jet recording apparatus are formed integrally with the container body 12.

Figure 3:
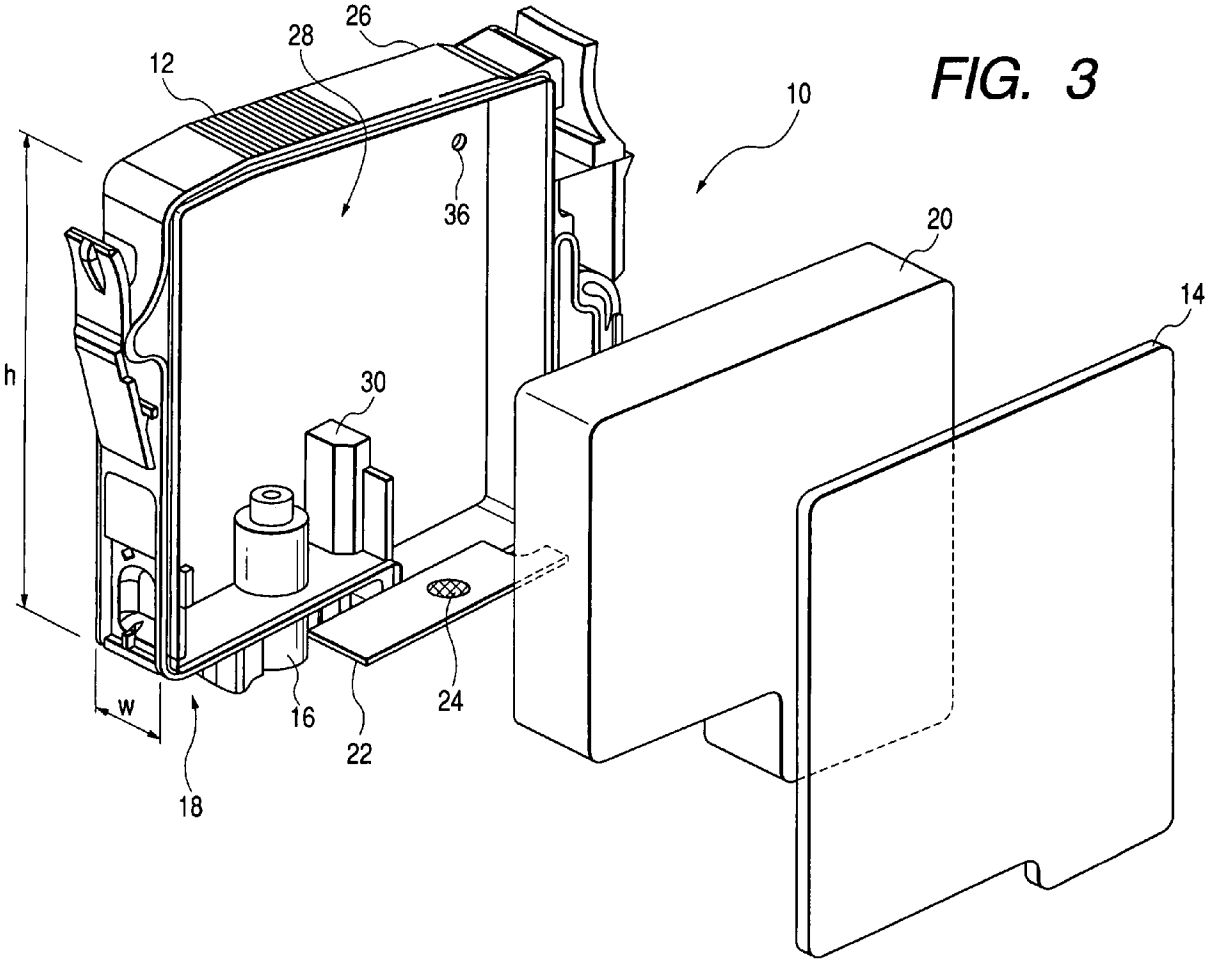
FIG. 3 is an exploded perspective view of the ink cartridge in the first embodiment.

FIG. 3 is an exploded perspective view of the ink cartridge 10 in the first embodiment. The ink cartridge 10 includes the above container body 12 and the lid member 14, and further includes a porous member 20 to be housed in the space formed by the container body 12 and the lid member 14, and a pressure-contacting portion 22 provided in the vicinity of the ink supply passage 16 in parallel to the ink supply surface.

The container body 12 has a shape of an approximately rectangular parallelepiped in which one side surface is opened. In the container body 12, the ink supply passage 16 communicating from the outside of the container body 12 to the inside thereof is provided on the ink supply surface 18. The slit portion 30 forms a convex portion extruding inward of the container body 12. In a side surface 26 approximately orthogonal to the ink supply surface 18 of the container body 12, its height h is larger than at least one width w of the ink supply surface 18. As described above, in the On-carriage type ink jet recording apparatus, since as many ink cartridge as possible are mounted on the carriage, the width of the ink cartridge in the carriage scanning direction is frequently made small. For example, the height of the ink cartridge becomes several times as large as the width thereof. Correspondingly, the height h of the container body 12 is also made several times as large as the width w thereof.

One of the side surfaces of the container body 12 having the shape of the approximately rectangular parallelepiped is opened in this width direction thereby to form an opening surface 28. In this embodiment, the opening surface 28 is one of surfaces having the largest area in six surfaces constituting the approximately rectangular parallelepiped shaped container body 12. Hereby, it is easy to insert the porous member 20 into the container body 12 from the opening surface 12.

The container body 12 further includes a vent hole 36. communicating with the air. The air is brought through this vent hole 36 into the ink cartridge 10, and ink is supplied through the ink supply passage 16 from the inside of the ink cartridge 10 to the ink jet recording apparatus. Further, the vent hole 36 is preferably sealed by a film having ink-repellent property and gas-permeability. Further, the vent hole 36 may be connected to a capillary so that the inside of the ink cartridge 10 is communicated with the air through the capillary.

The lid member 14 is a plate-like member having the approximately same shape as the opening surface 28 of the container body 12. The lid member 14 is welded to the container body 12 and seals the opening surface 28 of the container body 12. Further, a film may be applied onto the opening surface 28 of the container body 12 and thereafter the lid member 14 may be welded to the container body 12 from the film side. Hereby, the space inside the ink cartridge 10 can be surely sealed.

The porous member 20 has many small pores therein, and ink is held in these small pores by the capillary power. Though, this porous member 20 has a shape of a rectangular parallelepiped as described later, it is shown in FIG. 3 in a deformed state in which the porous member 20 is pressure-contacted by the pressure-contacting portion 22 and housed into the container body 12.

The pressure-contacting portion 22 is a plate-like member provided on the ink supply passage 16 in parallel to the ink supply surface 18. In this embodiment, the pressure-contacting portion 22 is a member discrete from the container body 12. However, the invention is not limited to this, but the pressure-contacting portion 22 may be molded integrally with the container body 12. The pressure-contacting portion 22 has, in its position corresponding to the ink supply passage 16, a filter 24 through which ink from the porous member 20 passes. This filter 24 can prevent foreign matter included in the ink from getting mixed in the ink jet recording apparatus by filtering the foreign matter.

Figure 4B:
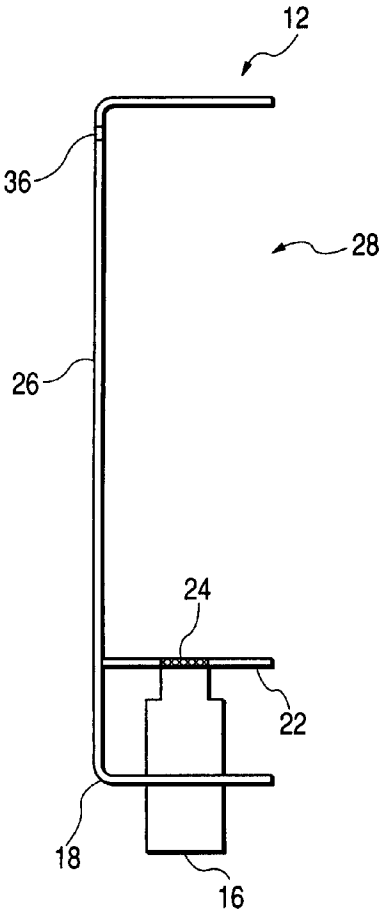
FIG. 4B is a sectional view of a portion near an ink supply passage 16 in FIG. 4A, taken in parallel to the inserting direction of an ink needle.
Figure 4A:
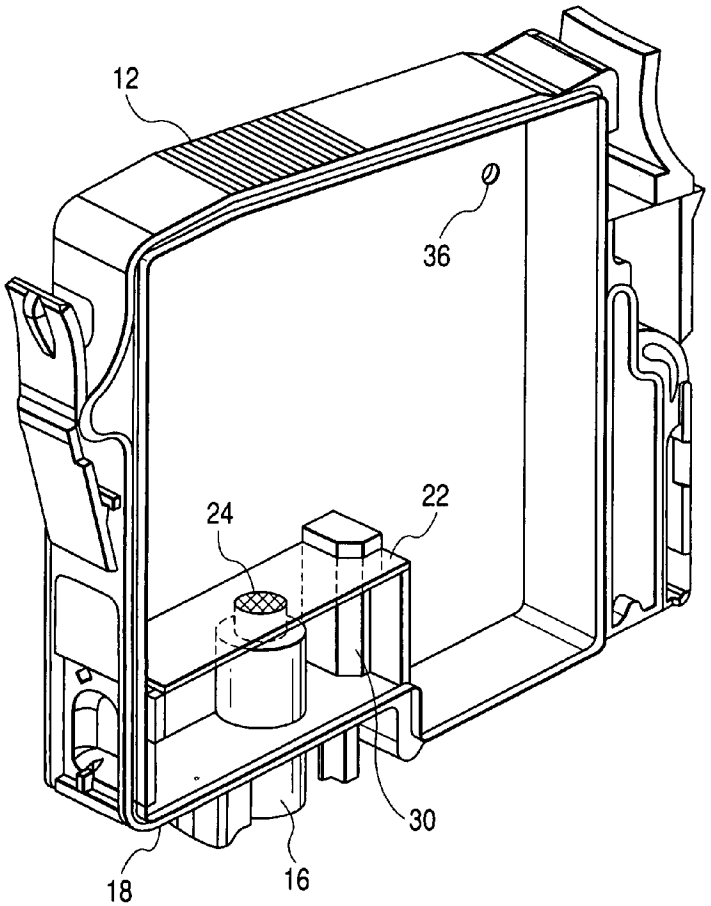
FIG. 4A is a perspective view showing an initial state for explaining a manufacturing method of the ink cartridge in the first embodiment.
Figure 5:
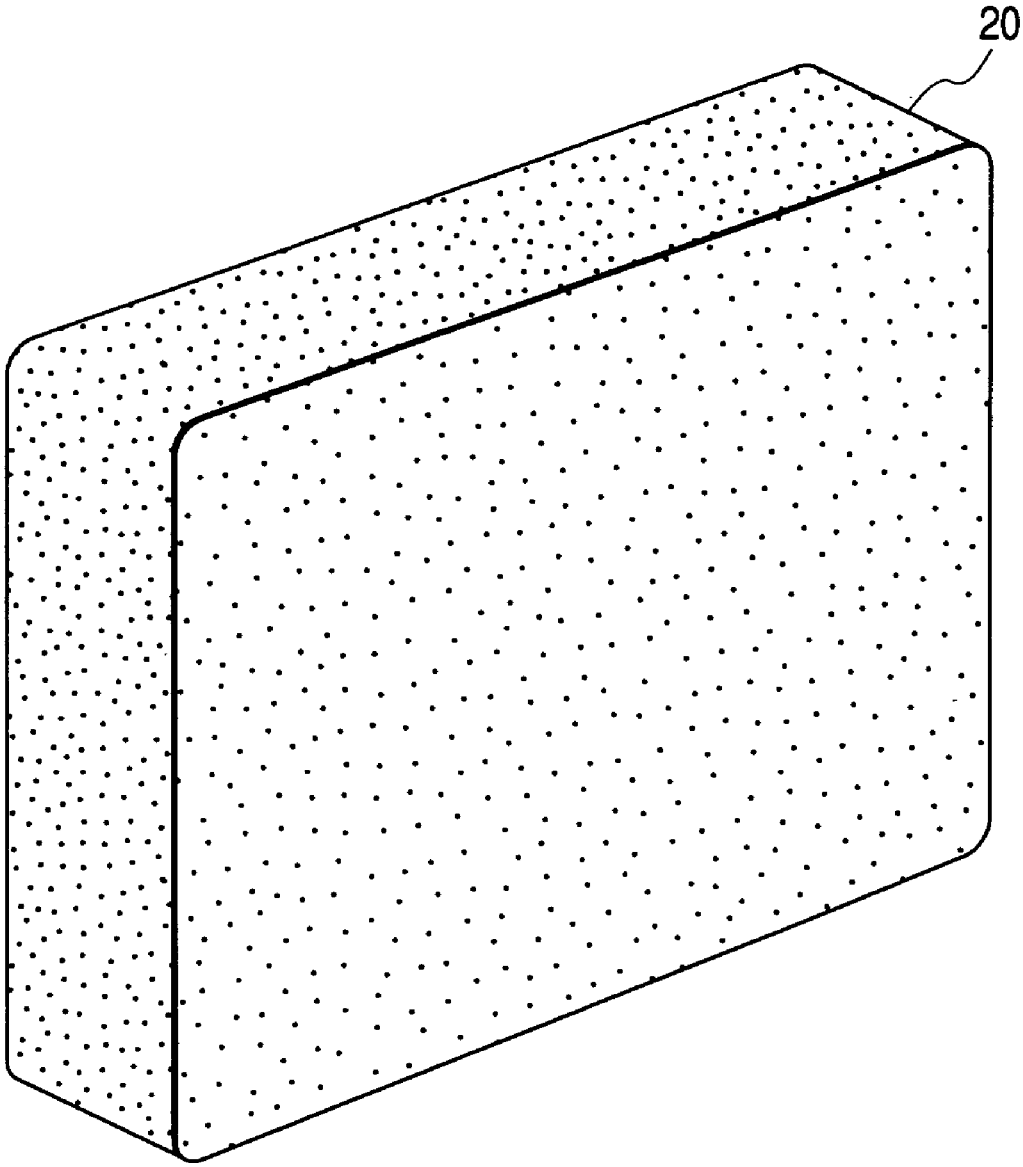
FIG. 5 is a perspective view showing a porous member to be inserted into a container body.

FIG. 4A is a perspective view showing an initial state in order to explain a manufacturing method of the ink cartridge 10 in the first embodiment. FIG. 4B is a sectional view of a portion near an ink supply passage 16 in FIG. 4A, taken in parallel to the inserting direction of an ink needle, and FIG. 4B is shown simply in order to make the explanation easy. In these figures, a container body 12, similarly to that shown in FIG. 3, has a shape of an approximately rectangular parallelepiped including an ink supply surface 18, in which the height of a side surface 26 approximately orthogonal to the ink supply surface 18 is larger than at least one width of the ink supply surface 18, and one of the side surfaces is opened to provide an opening surface 28, and the container body 12 is molded integrally. Further, a pressure-contacting portion 22 having a filter 24 is provided on the ink supply passage 16 in parallel to the ink supply surface FIG. 5 is a perspective view showing a porous member 20 to be inserted into the container body 12. The porous member 20 has a shape of a rectangular parallelepiped that is the approximately same as the container body 12. From FIG. 5 on, spots shown in the porous member 20 represent a density of the porous member. In the figure, a portion where spots are shown densely, in which the porous member 20 is compressed and dense, indicates that capillary power is strong.

Figure 6:
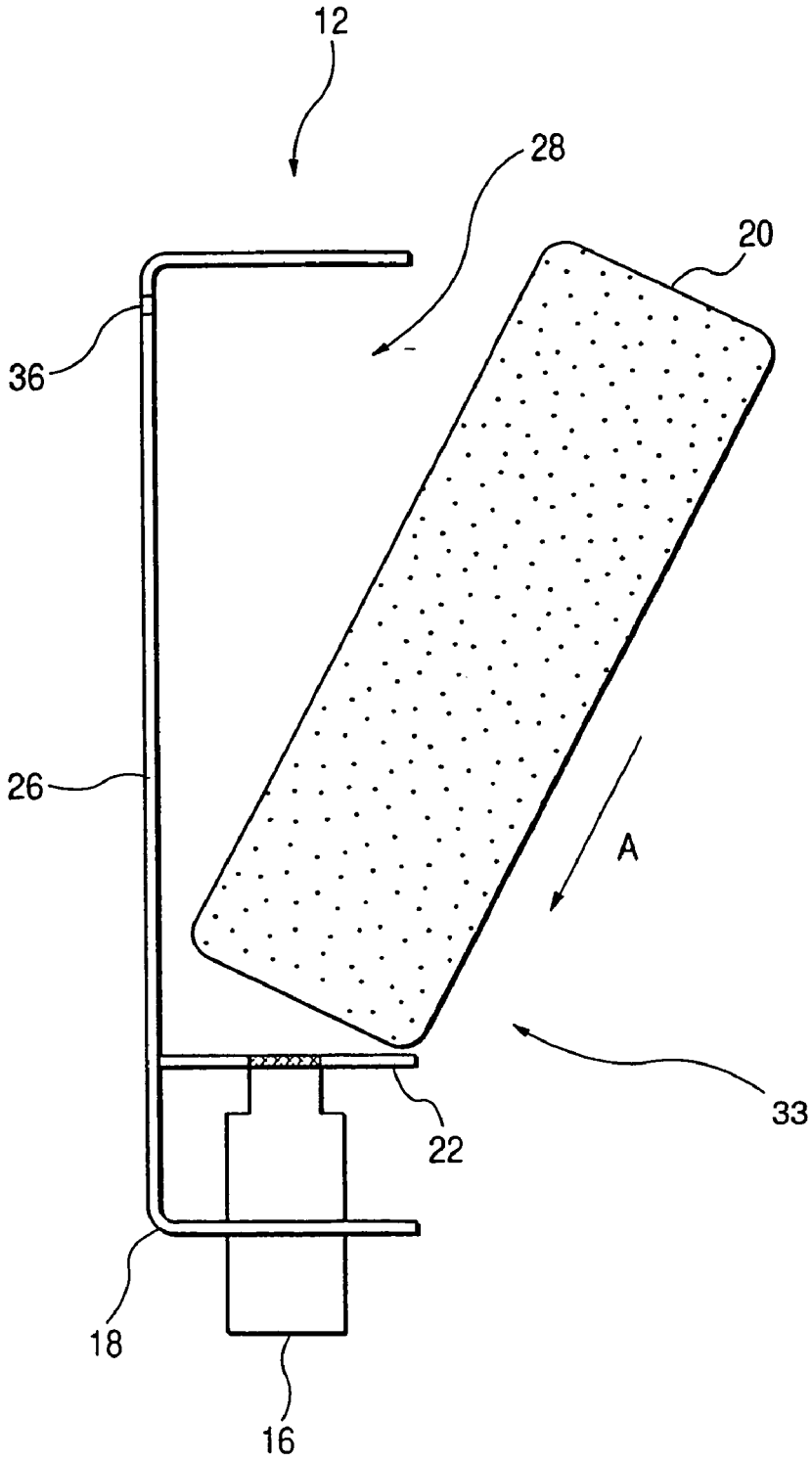
FIG. 6 is a sectional view showing a first step of a process for inserting the porous member into the container body.

FIG. 6 is a sectional view showing a first step of a process for inserting the porous member 20 into the container body 12. Firstly, a portion 33 of the porous member 20 near the ink supply surface 18 is pressed toward the ink supply surface 18 in the direction of an arrow A. More particularly, the portion 33 of the porous member 20 is pressed from the slanting upside of the opening surface 28 against the pressure-contacting portion 22 provided in the vicinity of the ink supply passage 16 in parallel to the ink supply surface 18.

Figure 7:
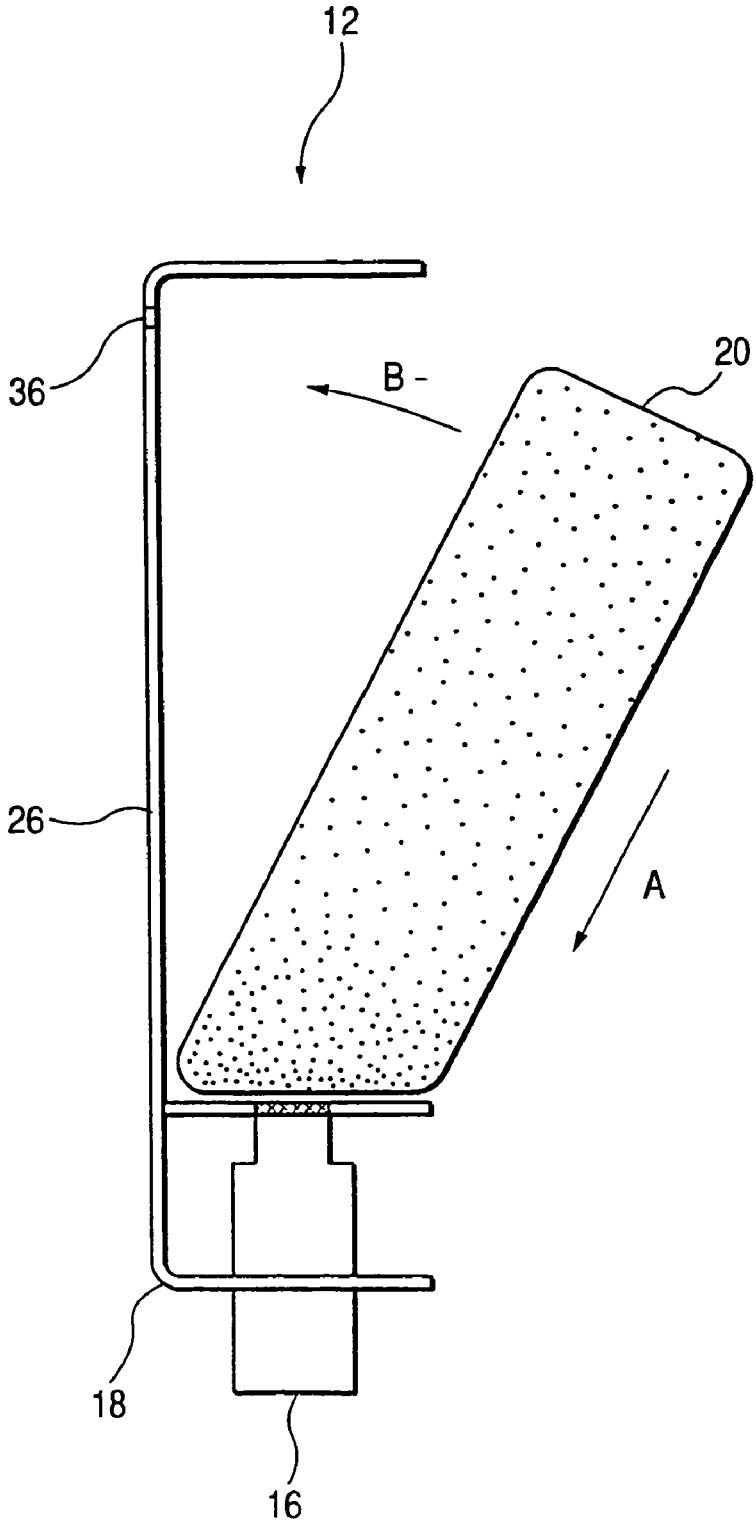
FIG. 7 is a sectional view showing a second step of the process for inserting the porous member into the container body.

FIG. 7 is a sectional view showing a second step of the process for inserting the porous member 20 into the container body 12. Sequentially to the first step in FIG. 6, the portion 33 of the porous member 20 near the ink supply surface 18 is pressed in the direction of an arrow A thereby to compress more this portion 33. After the porous member 20 has been compressed so that the height of the porous member 20 becomes the same as the length between the pressure-contacting portion 22 and the upper surface of the container body 12, the whole of the porous member 20 is inserted into the container body 12 so as to be turned in the direction of an arrow B.

Figure 8B:
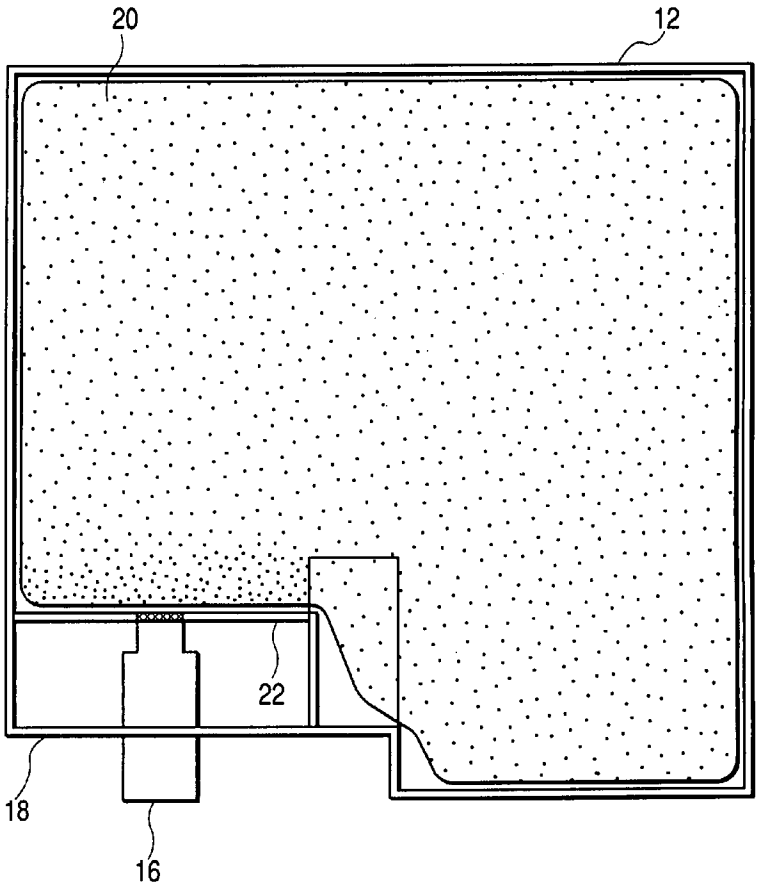
FIGS. 8A and 8B are sectional views showing the states where the porous member is housed into the container body.
Figure 8A:
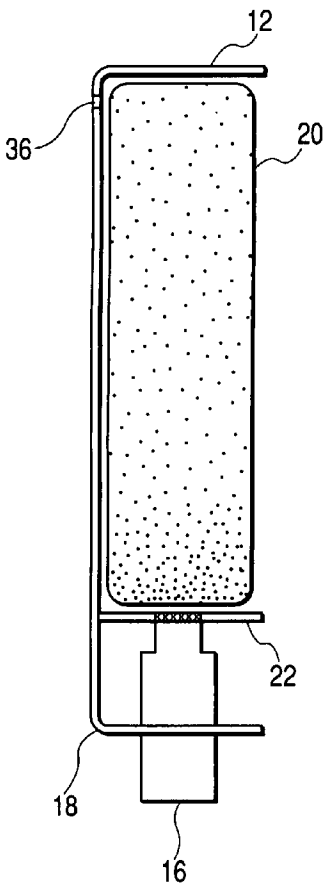

FIGS. 8A and 8B show the states where the porous member 20 is housed into the container body 12. FIG. 8A is a sectional view, and FIG. 8B is a sectional diagram viewed from the direction orthogonal to FIG. 8A. The porous member 20 is pressed against the pressure-contacting portion 22 and inserted into the container body 12. In the housing state, the porous member 20 around the pressure-contacting portion 22 is compressed. In case that the porous member 20 has been compressed, a pore diameter of the small pore becomes small, so that the capillary power becomes stronger. Namely, the compressed portion is stronger in ink holding power than the no-compressed portion. Therefore, the ink held in the porous member 20 is easy to collect at the compressed portion around the pressure-contacting portion 22. Hereby, the ink is incessantly supplied from the porous member 20 through the ink supply passage 16 to the ink jet recording apparatus.

Figure 9:
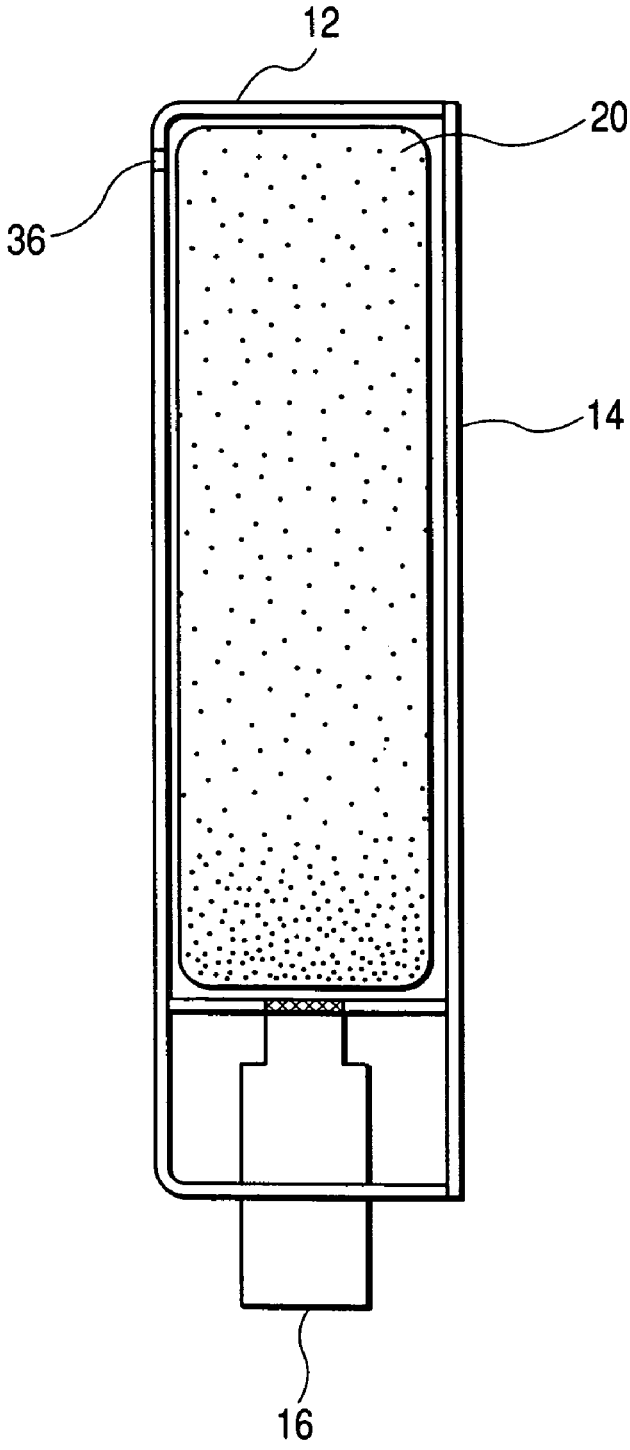
FIG. 9 is a sectional view showing the state where a lid member is attached to the container body.

FIG. 9 is a sectional view showing the state where a lid member 14 is attached to the container body 12. From the states shown in FIGS. 8A and 8B, the lid member 14 is attached to the container body 12 so as to seal the opening portion 28. As an example of this attachment, the lid member 14 is attached to the container body 12 by vibration-welding. Hereby, the porous member 20 is housed in the sealed space.

After the lid member 14 has been attached to the container body 12, the ink cartridge 10 is placed in a pressure reduction room in which pressure is reduced, and the space surrounded by the container body 12 and the lid member 14 is pressure-reduced. Ink is put into the pressure-reduced space surrounded by the container body 14 and the lid member 14 from, for example, the ink supply passage 16 thereby to permit the porous member 20 to include the ink. As described above, the ink cartridge 10 is manufactured.

According to the first embodiment, the opening surface is one of the surfaces having the largest area in six surfaces constituting the approximately rectangular parallelepiped-shaped container body, and in the ink cartridge manufacturing method, the porous member is inserted into the container body from this opening surface side. Therefore, the insertion of the porous member is easy. Further, after the portion of the porous member near the ink supply passage has been pressed against the pressure-contacting portion and compressed, the porous member is inserted into the container body. Therefore, the ink collects around the ink supply passage, so that it is possible to provide an ink cartridge which supplies ink stably.

Figure 10B:
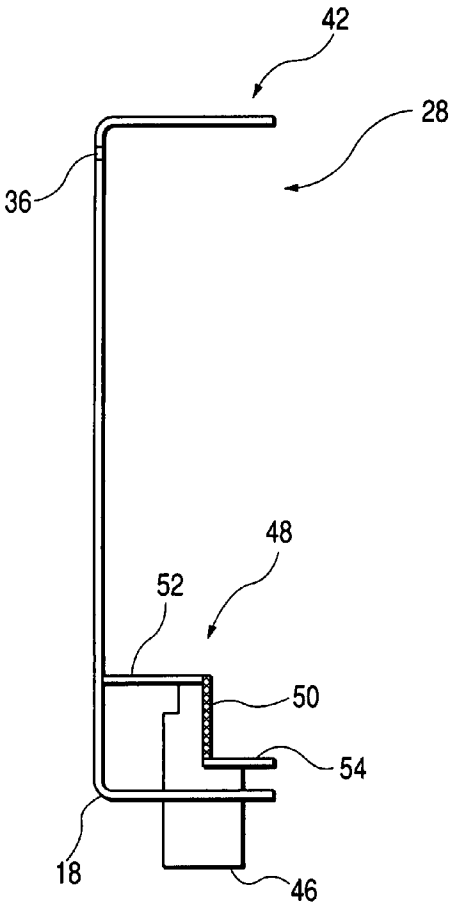
FIG. 10B is a sectional view of a portion near an ink supply passage in FIG. 10A, taken in parallel to the inserting direction of an ink needle.
Figure 10A:
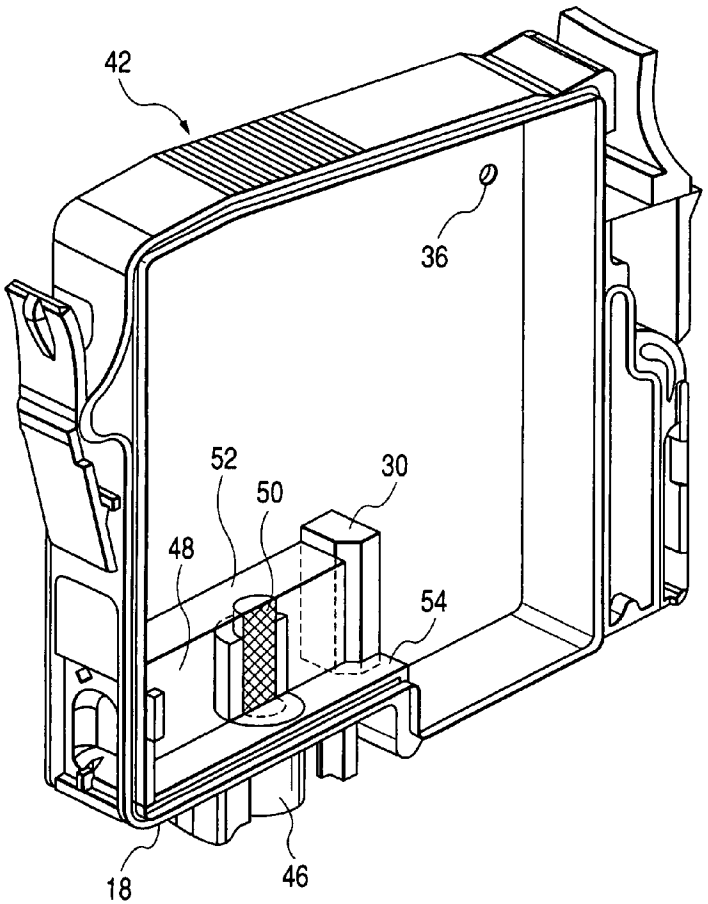
FIG. 10A is a perspective view showing an initial state for explaining a manufacturing method of an ink cartridge in a second embodiment.

FIG. 10A is a perspective view showing an initial state in order to explain a manufacturing method of an ink cartridge 40 in a second embodiment. FIG. 10B is a sectional, view of a portion near an ink supply passage 46 in FIG. 10A, taken in parallel to the inserting direction of an ink needle, and FIG. 10B is shown simply in order to make the explanation easy. In these figures, parts similar to those in the first embodiment shown in FIG. 1 are denoted by the same reference numerals.

In a container body 42 of the ink cartridge 40 in the second embodiment, a pressure-contacting portion 48 perpendicular to an ink supply surface 18 is provided on the ink supply passage 46. The pressure-contacting portion 48 has on its both sides horizontal plates 52 and 54 which are parallel to the ink supply surface 18 and different in height from each other. A filter 50 is provided for a portion of the pressure-contacting portion 48 corresponding to the ink supply passage 46.

Figure 11B:
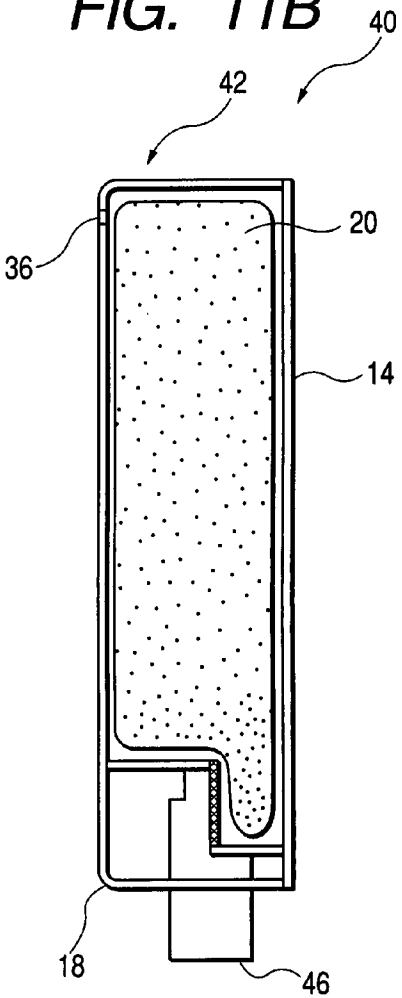
FIGS. 11A and 11B are diagram showing stepwise the manufacturing method of the ink cartridge in the second embodiment.
Figure 11A:
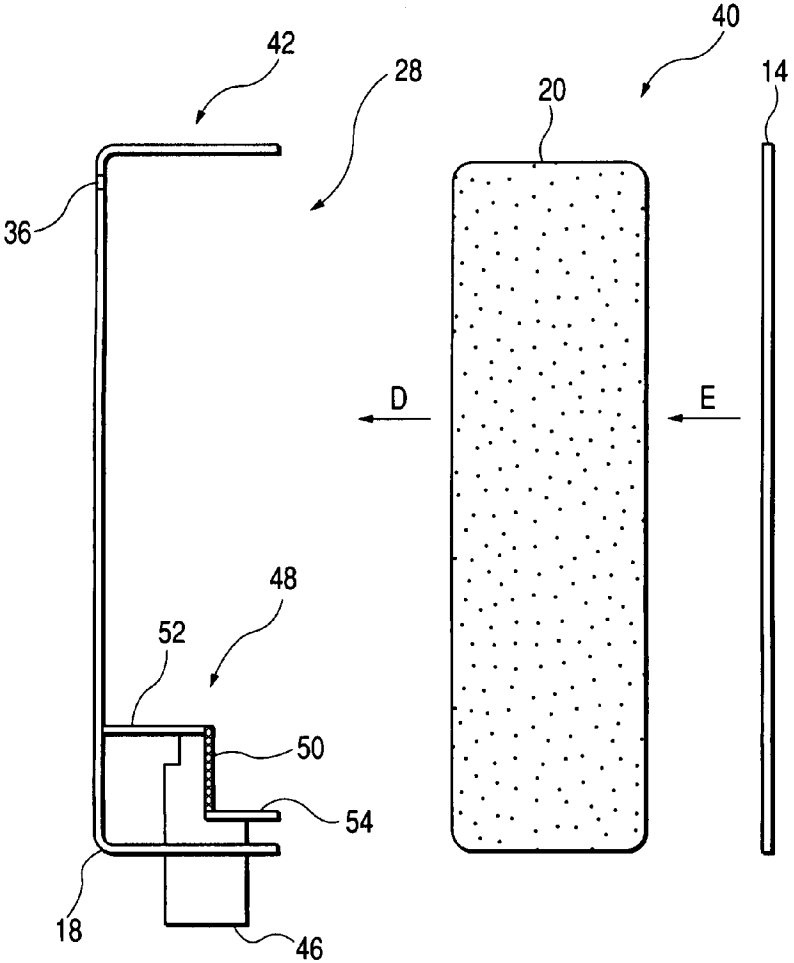

FIGS. 11A and 11B are diagram showing, step-by-step, the manufacturing method of the ink cartridge 40 in the second embodiment. As shown in FIG. 11A, a porous member 20 is inserted into the container body 42 from an opening surface 28 of the ink cartridge 40. In this case, similarly to in the first embodiment, the porous member 20 may be pressed from the slanting upside of the opening surface 28 and thereafter inserted into the container body 42 completely.

However, the pressure-contacting portion 48 of the ink cartridge 40 in the second embodiment is provided on the ink supply surface 18 perpendicularly. Accordingly, the porous member 20 may be inserted from an opening of the opening surface 28 in the direction of an arrow D while a portion of the porous member 20 near the ink supply passage 18 is being pressed against the pressure-contacting portion 48. Thereafter, a lid member 14 is welded to the opening surface 28 of the container body 42 in the direction of an arrow E.

As shown in FIG. 11B, in the thus housed porous member 20, the portion of the porous member near the ink supply passage 18 is pressed against the pressure-contacting portion 48 and compressed. Hereby, ink collects near this portion, and ink can be supplied to the ink jet recording apparatus without causing a shortage of ink.

According to the second embodiment, the similar effects to those in the first embodiment can be obtained. Further, since the pressure-contacting portion in the second embodiment is perpendicularly provided on the ink supply surface, in case that the porous member is inserted from the opening direction of the opening surface, the porous member is pressed against the pressure-contacting portion and compressed. Hereby, insertion of the porous member is easier, so that it is possible to manufacture an ink cartridge which supplies ink stably.

Figure 12B:
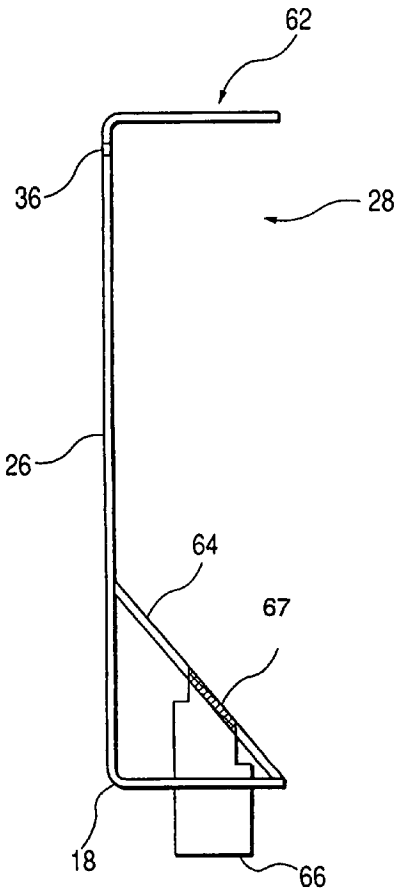
FIG. 12B is a sectional view of a portion near an ink supply passage in FIG. 12A, taken in parallel to the inserting direction of an ink needle.
Figure 12A:
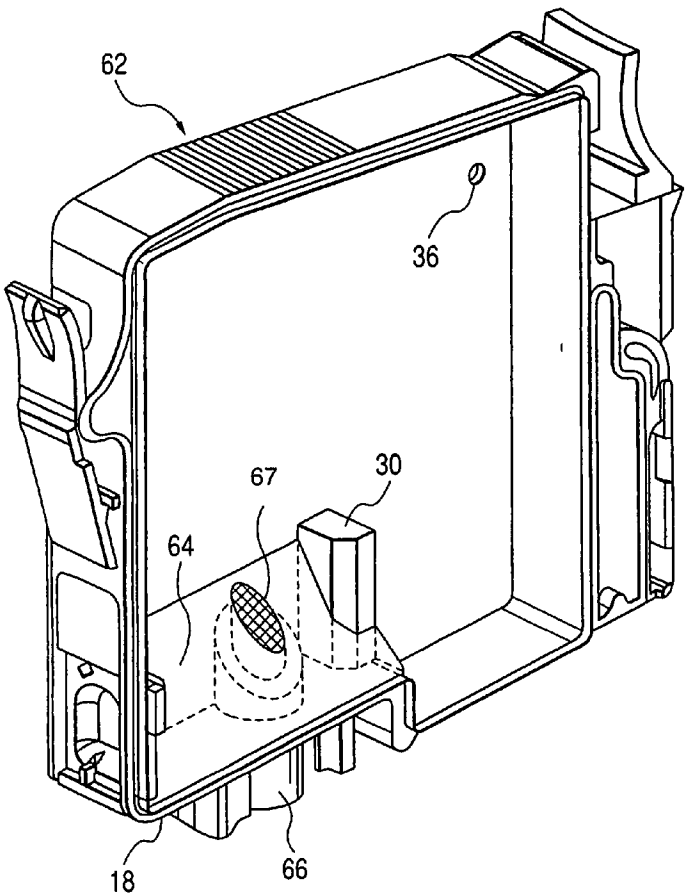
FIG. 12A is a perspective view showing an initial state for explaining a manufacturing method of an ink cartridge in a third embodiment.

FIG. 12A is a perspective view showing an initial state in order to explain a manufacturing method of an ink cartridge 60 in a third embodiment. FIG. 12B is a sectional view of a portion near an ink supply passage 66 in FIG. 12A, taken in parallel to the inserting direction of an ink needle, and FIG. 12B is shown simply in order to make the explanation easy. In these figures, parts similar to those in the first embodiment shown in FIG. 1 are denoted by the same reference numerals.

In a container body 62 of the ink cartridge 60 in the third embodiment, a pressure-contacting portion 64 inclining with respect to an ink supply surface 18 is provided on the ink supply passage 66. The pressure-contacting portion 64 inclines so that a side surface 26 side becomes higher than an opening surface 28 side. A filter 67 is provided for a portion of the pressure-contacting portion 64 corresponding to the ink supply passage 66.

Figure 13B:
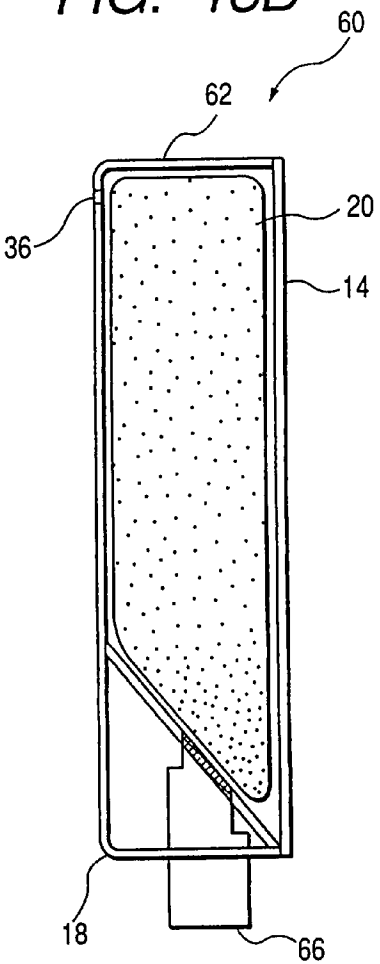
FIGS. 13A and 13B are diagram showing stepwise the manufacturing method of the ink cartridge in the third embodiment.
Figure 13A:
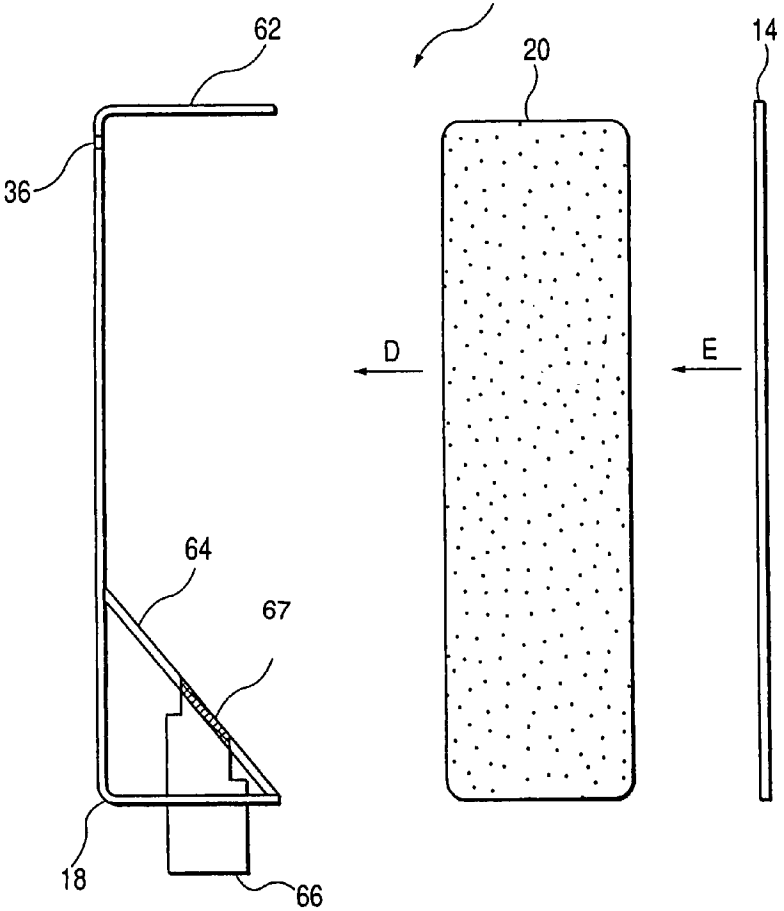

FIGS. 13A and 13B are diagram showing, step-by-step, the manufacturing method of the ink cartridge 60 in the third embodiment. As shown in FIG. 13A, a porous member 20 is inserted into a container body 62 from the opening surface 28 of the ink cartridge 60. In this case, similarly to in the first embodiment, the porous member 20 may be pressed from the slanting upside of the opening surface 28 and thereafter inserted into the container body 62 completely.

However, the pressure-contacting portion 64 of the ink cartridge 60 in the third embodiment is provided on the ink supply surface 18 with an inclination. Accordingly, the porous member 20 may be inserted from an opening of the opening surface 28 in the direction of an arrow D while a portion of the porous member 20 near the ink supply passage 18 is being pressed against the pressure-contacting portion 64. Thereafter, a lid member 14 is welded to the opening surface 28 of the container body 62 in the direction of an arrow E.

As shown in FIG. 13B, in the thus housed porous member 20, the portion of the porous member near the ink supply passage 18 is pressed against the pressure-contacting portion 64 and compressed. Hereby, ink collects near this portion, and ink can be supplied to the ink jet recording apparatus without causing a shortage of ink.

According to the third embodiment, the similar effects to those in the first embodiment can be obtained. Further, since the pressure-contacting portion in the third embodiment is provided on the ink supply surface with an inclination, in case that the porous member is inserted from the opening direction of the opening surface, the porous member is pressed against the pressure-contacting portion and compressed. Hereby, insertion of the porous member is easier, so that it is possible to manufacture an ink cartridge which supplies ink stably.

In each of the first to third embodiments, it is preferable that a reinforcing structure is provided in the ink cartridge in order to reinforce mechanical strength of the ink cartridge in its width direction. Taking the first embodiment as an example, embodiments in which the reinforcing structure is provided will be described below. In the following embodiments, as a preferable example of the reinforcing structure, a rib is taken. However, the invention is not limited to this.

Figure 14:
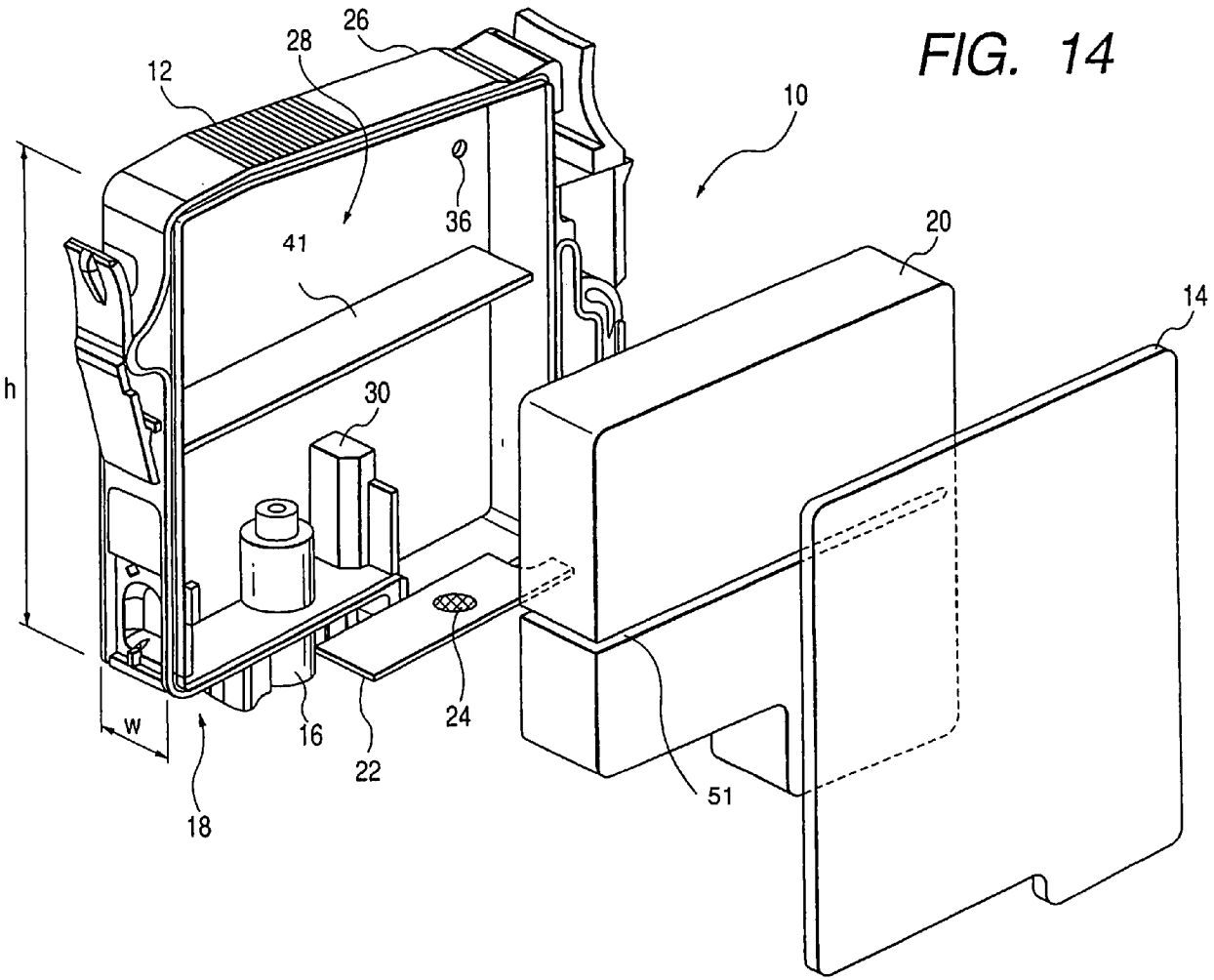
FIG. 14 is an exploded perspective view of an ink cartridge in a fourth embodiment.

FIG. 14 is an exploded perspective view of an ink cartridge 10 in a fourth embodiment.

In the space formed by a container body 12 and a lid member 14, a rib 41 is provided, which reinforces mechanical strength of the ink cartridge 10 in its width direction.

A porous member 20, as described later, has a shape of a rectangular parallelepiped including a slit 51 corresponding to the rib 41 of the container body 12. However, in FIG. 14, the porous member 20 is shown in a deformed state where it is pressure-contacted by a pressure-contacting portion 22 and housed in the container body 12.

Figure 15A:
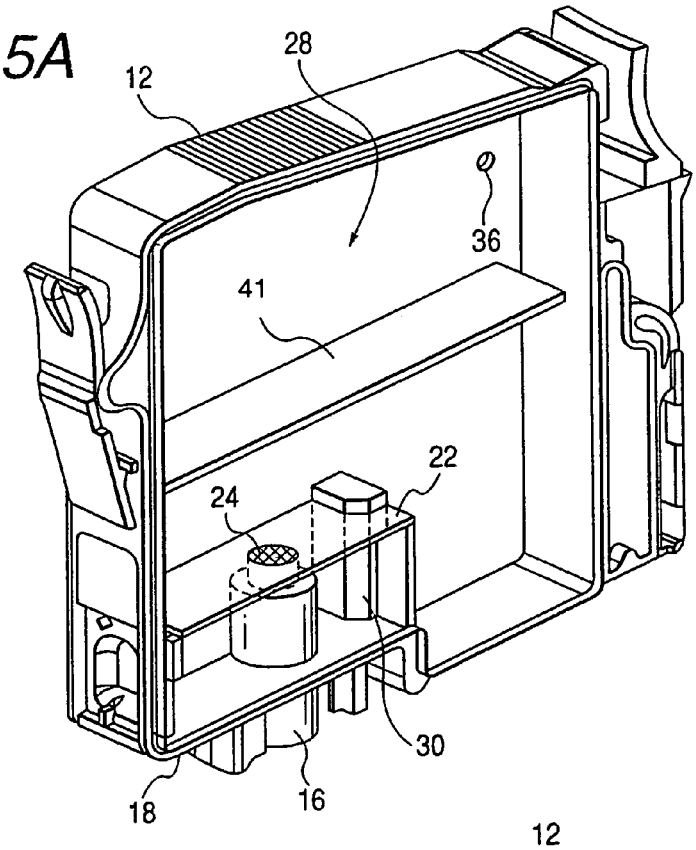
FIG. 15A is a perspective view of a container body of the cartridge in FIG. 14.
Figure 15B:
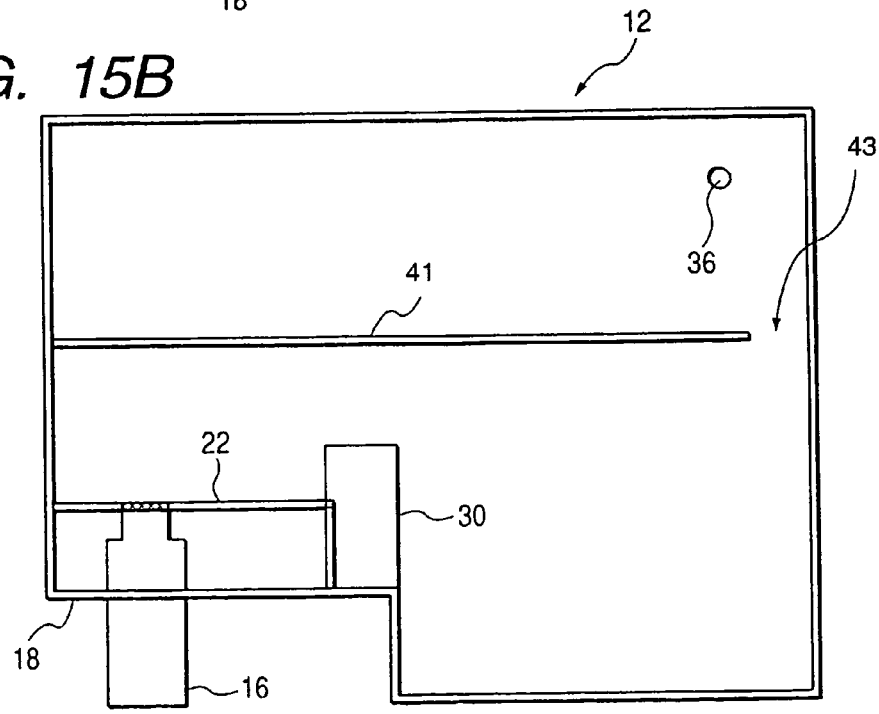
FIG. 15B is a front schematic view in which the container body in FIG. 15A is viewed from the direction of an opening surface.

The container body 12 has the rib 41 provided in parallel to an ink supply surface 18. The rib 41 is formed integrally with the container body 12 in this embodiment. This rib 41 extends from a side near an ink supply passage 16, that is, a left side in FIG. 15B to a side far from the ink supply passage 16, that is, a right side in FIG. 15B. An end portion of the rib 41 far from the supply passage 16 is not connected to the container body 12 to form a communicating passage 43.

The container body 12 has the rib 40 provided in parallel to an ink supply surface 18. The rib 40 is formed integrally with the container body 12 in this embodiment. This rib 40 extends from a side near an ink supply passage 16, that is, a left side in FIG. 15B to a side far from the ink supply passage 16, that is, a right side in FIG. 15B. An end portion of the rib 16 far from the supply passage 16 is not connected to the container body 12 to form a communicating passage 42.

Figure 16:
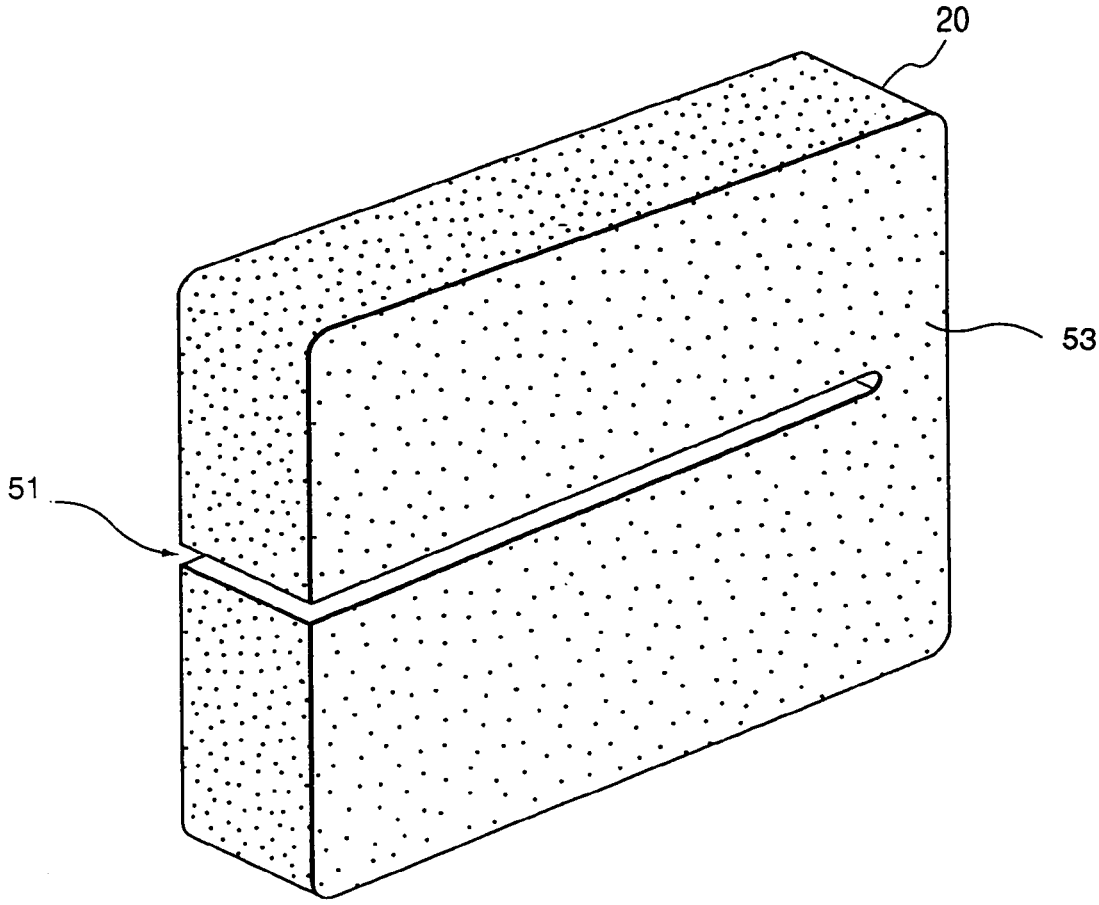
FIG. 16 is a perspective view of a porous member to be housed in a space formed by a container body and a lid member.

FIG. 16 is a perspective view of the porous member 20 housed in the space formed by the container body 12 and the lid member 14. The porous member 20 has a shape of a rectangular parallelepiped that is the approximately same as the shape of the container body 12. The porous member 20 further has the slit 51 at its portion corresponding to the rib 41 of the container body 12. One end of this slit 51 is opened, and the other end thereof is not opened but forms a connecting portion 53 that connects a upper half and a lower half of the porous member 20. Since the upper half and the lower half are connected physically by the connecting portion 53, the porous member can be handled as a single member, so that it is easy to handle the porous member in a manufacturing process and the like.

Figure 17A:
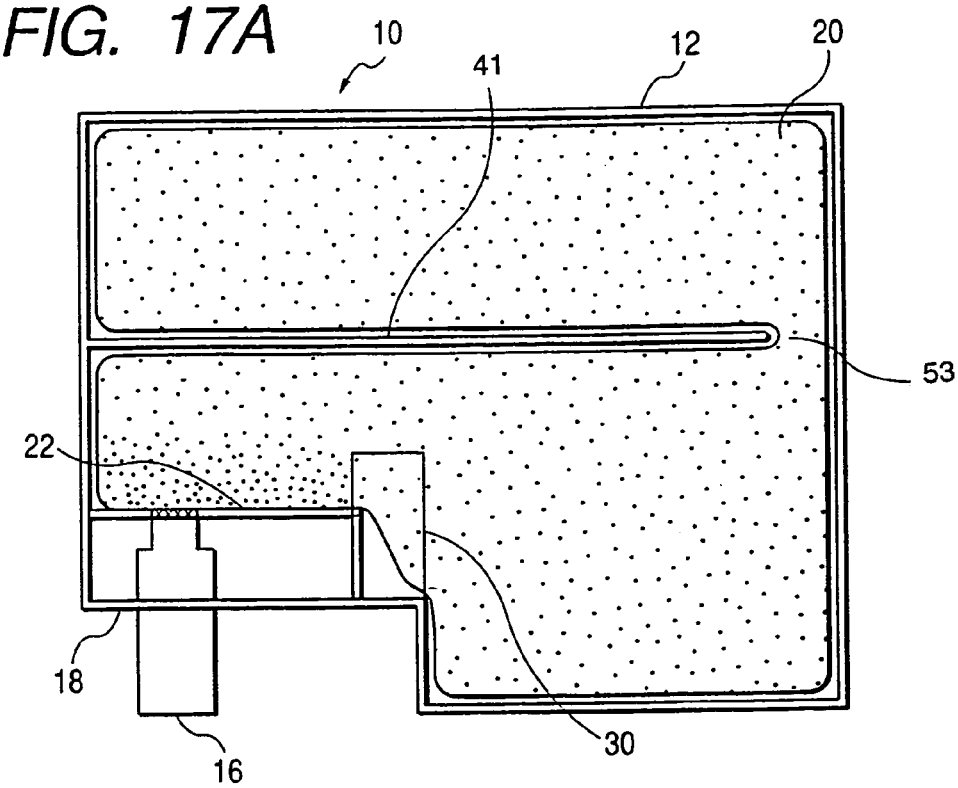
FIG. 17A is a side view in which the state where the porous member is housed in the container body is viewed from the opening surface side of the container body.
Figure 17B:
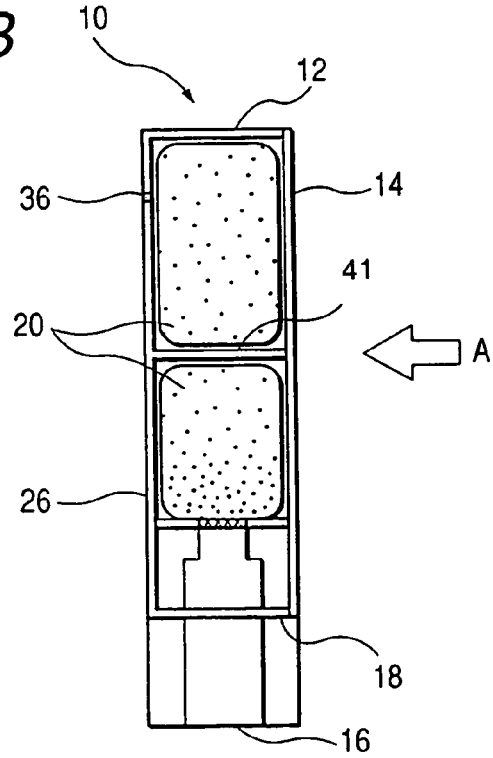
FIG. 17B is a sectional view in which the state in FIG. 17A is viewed from the direction orthogonal to the opening surface.

FIG. 17A is a side view in which the state where the porous member 20 is housed in the container body 12 in the ink cartridge 10 is viewed from the opening surface 28 side of the container body 12. However, for explanation, the lid member 14 is not shown. FIG. 17B is a sectional view in which the state in FIG. 17A is viewed from the direction orthogonal to the opening surface 28.

The porous member 20 of which the outline is approximately a rectangular parallelepiped is compressed at its portion pressure-contacted to the pressure-contacting portion 22, and inserted into the container body 12. The capillary power of a portion of the porous member 20 where is near the ink supply passage 16 becomes high by this compression, so that ink collects at this portion. Therefore, the ink can be supplied to the outside without causing a shortage of ink. With the insertion of this porous member 20 into the container body 12, the rib 41 of the container body 12 is inserted into the slit 51 of the porous member 20. Further, the connecting portion 53 of the porous member 20 is inserted into the communicating portion 43 of the container body 12. Hereby, the porous member 20 is housed in the space formed by the container body 12 and the lid member 14 so as to evade the rib 41 and surround it.

The lid member 14 is joined to the container body 12 as to seal the opening surface 28. In this case, in the embodiment, an end portion of the rib 41 is also joined to the lid member 14. Hereby, the mechanical reinforcement by the rib 41 becomes stronger.

After the lid member 14 has been joined to the container body 12, the ink cartridge 10 is placed in a pressure reduction room in which pressure is reduced, and the space surrounded by the container body 12 and the lid member 14 is pressure-reduced. Ink is put into the pressure-reduced space surrounded by the container body 14 and the lid member 14, for example, from the ink supply passage 16 thereby to permit the porous member 20 to include the ink. As described above, the ink cartridge 10 is manufactured.

According to the above fourth embodiment, the mechanical strength of the ink cartridge 10 in the direction of an arrow A in FIG. 17B can be reinforced by the rib 41. Further, since the rib 41 is inserted into the slit 51, the porous member 20 is not compressed around the rib 41, so that it is possible to prevent ink from unnecessarily concentrating in this portion. Further, in the ink cartridge 10, as much ink as possible can be held by the porous member 20 in the space formed by the container body 12 and the lid member 14.

In the fourth embodiment, though the rib 41 is provided in parallel to the ink supply surface, the invention is not limited to this. As another example, the rib 41 may be provided perpendicularly to the ink supply surface 18.

Further, in the fourth embodiment, though the rib 41 of the container body 12 is joined to the lid 14, the invention is not limited to this. As another example, when the lid member 14 is joined to the container body 12, a gap may be provided between the rib 41 and the lid member 14.

Figure 18A:
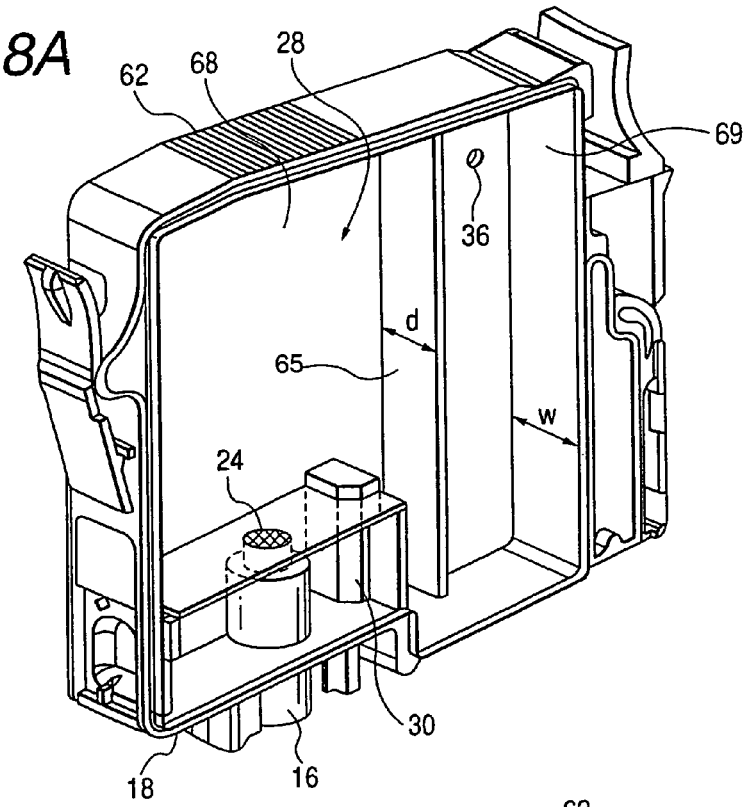
FIG. 18A is a perspective view of a container body of a cartridge in a fifth embodiment.
Figure 18B:
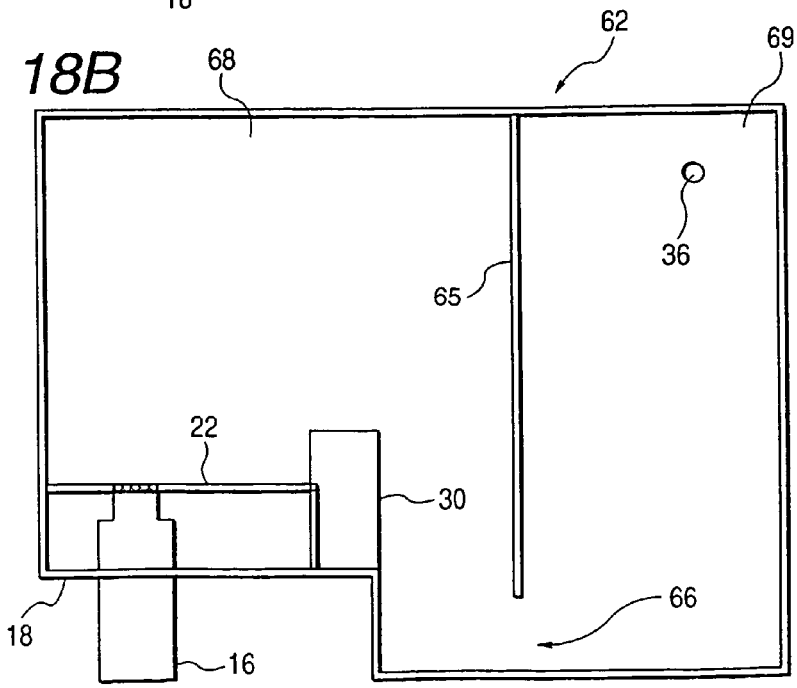
FIG. 18B is a front schematic view in which the container body in FIG. 18A is viewed from the direction of an opening surface.

FIG. 18A is a perspective view of a container body 62 of a cartridge 60 in a fifth embodiment, and FIG. 18B is a front schematic view in which the container body 62 in FIG. 18A is viewed from the direction of an opening surface 28. Parts similar to those of the ink cartridge in the fourth embodiment are denoted by the same reference numerals, and their explanation in omitted.

In the ink cartridge 60 according to the fifth embodiment, a rib 65 is provided perpendicularly to an ink supply surface 18. The rib 65 is formed integrally with the container body 62, extends perpendicularly downward from the inside of the upper surface of the container body, and includes a communicating portion 66 between it and the lower surface of the container body 62. The width d of the rib 65 is smaller than the inner width w' of the container body 62. The inside of the container body 62 is nearly divided into a first room 68 and a second room 69 by this rib 65.

Figure 19:
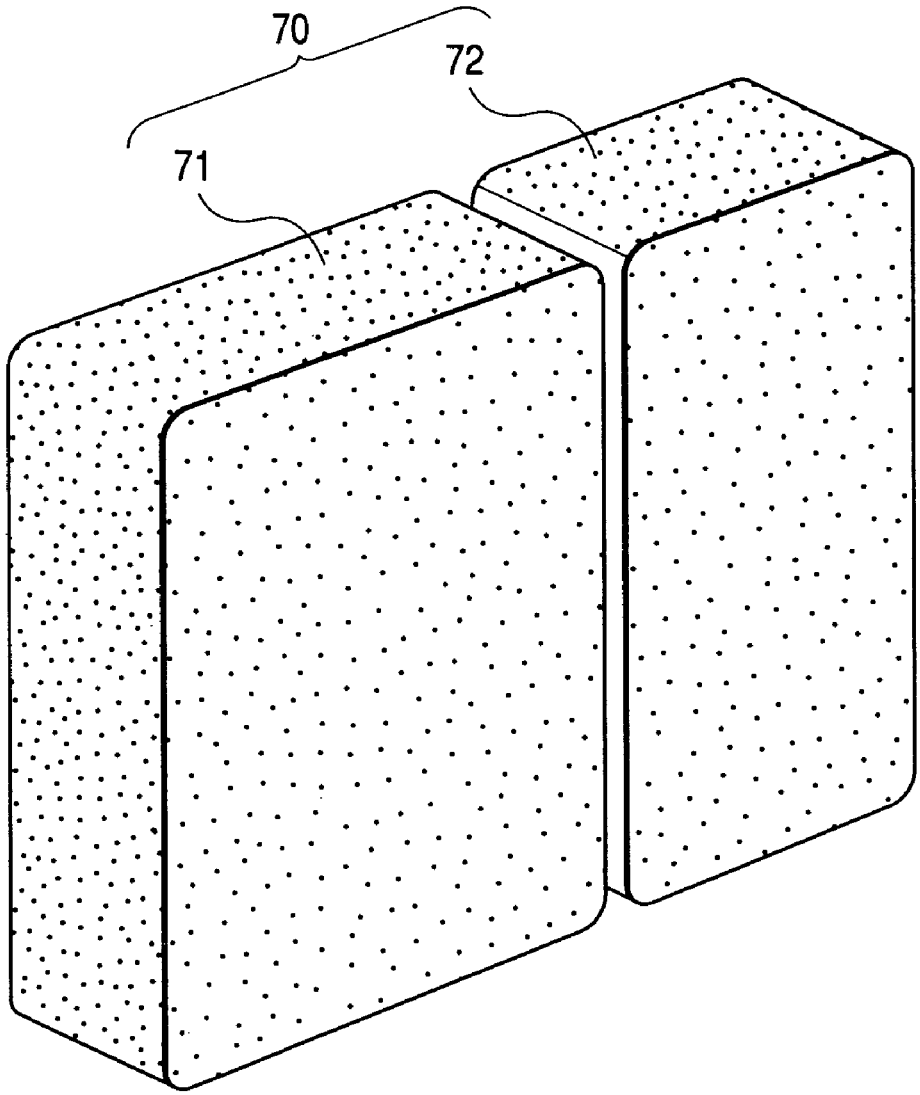
FIG. 19 is a perspective view of a porous member to be housed in the cartridge in the fifth embodiment.

FIG. 19 is a perspective view of a porous member 70 to be housed into the cartridge 60 in the fifth embodiment. This porous member 70 has a first porous member 71 and a second porous member 72 that are two individual members. The first porous member 71 has a shape of a rectangular parallelepiped that is the approximately same as the shape of the first room 68 of the container body 62. The second porous member 72 has a shape of a rectangular parallelepiped that is the approximately same as the shape of the second room 69 of the container body 62. The first porous member 71 and the second porous member 72 that are divided at a portion corresponding to the rib 65 of the container body 62 are combined, whereby the porous member 70 has a shape of a rectangular parallelepiped that is the approximately same as the shape of the container body 62 as a whole.

The first porous member 71 and the second porous member 72 may be made of the same material or may be made of the different material from each other. As an example of the different material, the first porous member 71 to be inserted into a portion near an ink supply passage 16 uses a material that is high in density and small in diameter of a small pore. On the other hand, the second porous member 72 uses a material that is low in density and large in diameter of the small pore. Hereby, while ink is concentrated in the first room near the ink supply passage 16 and a shortage of ink is prevented, a large quantity of ink can be held in the second room.

Further, the first porous member 71 and the second porous member 72 may be made of the same material and may be of the same size to obtain necessary effects. In this case, without increasing the number of kinds of parts, the ink cartridge can be readily manufactured.

Figure 20A:
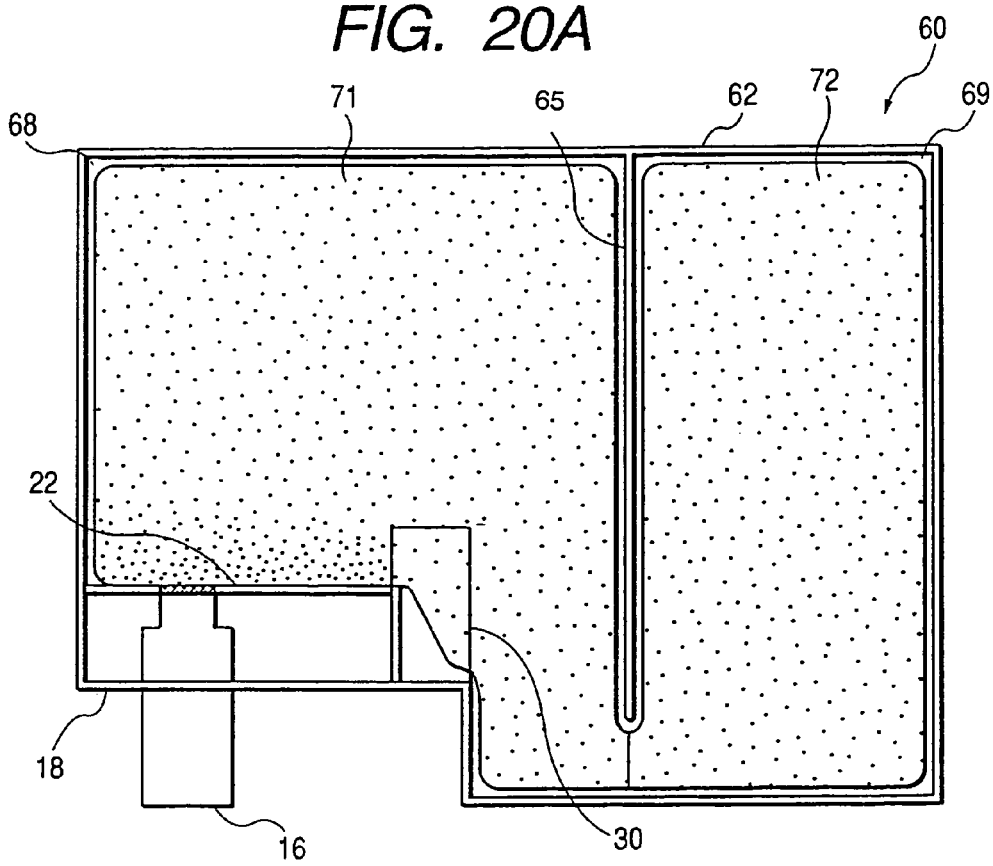
FIG. 20A is a side view in which the state where the porous member is housed in the container body is viewed from an opening surface side of the container body.
Figure 20B:
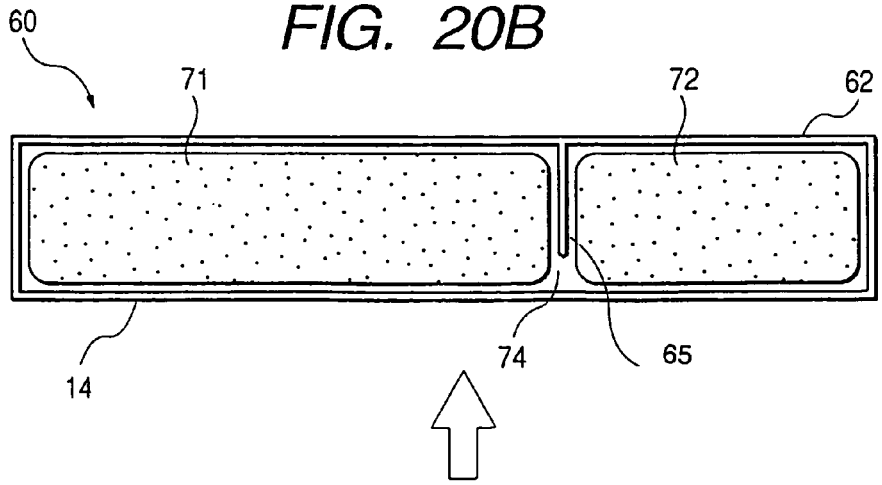
FIG. 20B is a sectional view in which the state in FIG. 20A is viewed from the upside.

FIG. 20A is a side view in which the state where the porous member 70 is housed in the container body 62 in the ink cartridge 60 is viewed from an opening surface 28 side of the container body 62. However, for explanation, a lid member 14 is not shown. FIG. 20B is a sectional view in which the state in FIG. 20A is viewed from the upside.

As shown in FIG. 20A, the first porous member 71 is inserted into the first room 68, the second porous member 72 is inserted into the second room 69, and the first and second porous members 71 and 72 come into contact with each other at the communicating portion 66. Under this state, the lid member 14 is joined to the opening surface 28 thereby to seal the porous member 70.

In this embodiment, since the width d of the rib 65 is smaller than the inner width w' of the container body 62, as shown in FIG. 20B, a gap 74 is formed between the rib 65 and the lid member 14. Therefore, when the lid member 14 is joined to the container body 62, the rib 65 is not joined to the lid member 14. Even if there is the rib 65, the joint portion between the container body 62 and the lid member 14 does not increase. Therefore, the ink cartridge 60 is readily manufactured.

As described above, according to the fifth embodiment, in the ink cartridge 60, the rib 65 can reinforce the mechanical strength in the direction of an arrow B in FIG. 20B. Further, though there is the gap 74 between the lid 14 and the rib 65, elasticity of the container body 62 or the lid 14 permits first deformation, and at the time of the next deformation, the rib 65 and the lid member 14 come into contact with each other thereby to substantially secure the mechanical strength.

Further, according to the fifth embodiment, in the ink cartridge 60, the porous member 70 is divided at its portion corresponding to the rib 65 into the first porous member 71 and the second porous member 72 that are the individual members. Therefore, around the rib 65, any of the porous members 71 and 72 are not compressed, and it is possible to prevent ink from unnecessarily concentrating on this portion. Further, as much ink as possible can be held by the first and second porous members 71 and 72 in the space formed by the container body 62 and the lid member 14.

In the fifth embodiment, though there is the gap 74 between the rib 65 and the lid 14, the width of the rib 65 may be made large to join the rib 65 to the lid member 14 similarly to in the fourth embodiment.

Further, in the fifth embodiment, though the porous member 70 is divided into the plural porous members, the slit may be provided for the integral porous member 70 similarly to in the fourth embodiment.

In either of the fourth and fifth embodiments, though the rib is formed integrally with the container body, the invention is not limited to this. As another example, there is a rib formed integrally with a lid member. Also, as other examples, a rib may be joined to a container body, or a gap may be provided between a rib and a container body.

Further, in the fourth and fifth embodiments, though the single rib is provided, the invention is not limited to this. Namely, a plurality of ribs may be provided.

Although the invention has been described with reference to the embodiments, the technical scope of the invention is not limited to the scope described in the above embodiments. Various changes or modifications can be added to the above embodiments. It is clear from the description of the scope of the patent claims that the embodiment to which such changes or modifications has been added can be also included in the technical scope of the invention.

What is claimed is:

1. An ink cartridge which supplies ink to an ink jet recording apparatus through an ink supply needle of the ink jet recording apparatus, comprising:

a container body including an ink supply surface on which an ink supply passage into which said ink supply needle is inserted is provided, and side surfaces, in which the height of at least one of said side surfaces of the container body approximately orthogonal to said ink supply surface is larger than at least one width of said ink supply surface, and one of said side surfaces is an opening surface that is opened in the direction of said width;

a lid member, which seals said opening surface of said container body;

a porous member, which is housed in a space formed by said container body and said lid member; and a press-contacting portion provided in the vicinity of said ink supply passage with an inclination to said ink supply surface, to which a part of said porous member is press-contacted to the press-contacting portion.

2. The ink cartridge according to claim 1, wherein said press-contacting portion has, in a position corresponding to said ink supply passage, a filter through which ink from said porous member passes.

3. The ink cartridge according to claim 2, wherein said porous member is divided into plural members at a portion corresponding in location to the rib.

4. The ink cartridge according to claim 1, further comprising a rib which is provided inside the space formed by said container body and said lid member and reinforces said ink cartridge in its width direction.

5. The ink cartridge according to claim 4, wherein said porous member has a shape avoiding said rib and surrounding it.

6. The ink cartridge according to claim 4, wherein said rib is formed integrally with at least one of said container body and said lid member.

7. The-ink cartridge according to claim 4, wherein said rib is provided in parallel or perpendicularly to said ink supply surface.

8. The ink cartridge according to claim 4, wherein a plurality of said ribs are provided.

9. The ink cartridge according to claim 4, wherein said porous member has a slit corresponding in location to the rib.

10. A manufacturing method of an ink cartridge supplying ink to an ink jet recording apparatus through an ink supply needle of the ink jet recording apparatus, comprising:

integrally forming a container body including an ink supply surface on which an ink supply passage into which said ink supply needle is inserted is provided, and side surfaces, in which the height of at least one of the side surfaces approximately perpendicular to said ink supply surface is larger than at least one width of said ink supply surface, and one of said side surfaces is an opening surface that is opened in the direction of said width;

inserting a porous member into said-container-body from said opening-surface, wherein a portion of said porous member near said ink supply surface is pressed against a press-contacting portion provided in the vicinity of said ink supply passage with an inclination to said ink supply surface; and sealing said opening surface of said container body into which said porous member is inserted with a lid member.

11. The manufacturing method according to claim 10, wherein in said sealing, said lid member is vibration-welded to said container body.

* * * * *